US009214763B2

(12) United States Patent
Tsai et al.

(10) Patent No.: US 9,214,763 B2
(45) Date of Patent: Dec. 15, 2015

(54) FLY LINE CONNECTOR

(71) Applicant: Delta Electronics, Inc., Taoyuan Hsien (TW)

(72) Inventors: Hsin-Wei Tsai, Taoyuan Hsien (TW); Ssu-Wei Fu, Taoyuan Hsien (TW); Ming-Cheng Lee, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 49 days.

(21) Appl. No.: 14/046,231

(22) Filed: Oct. 4, 2013

(65) Prior Publication Data

US 2014/0206219 A1 Jul. 24, 2014

(30) Foreign Application Priority Data

Jan. 18, 2013 (TW) ..... 102101904 A
Mar. 22, 2013 (TW) ..... 102205299 U

(51) Int. Cl.
*H01R 13/631* (2006.01)
*H01R 13/514* (2006.01)

(52) U.S. Cl.
CPC ..... *H01R 13/631* (2013.01); *H01R 13/514* (2013.01)

(58) Field of Classification Search
USPC ..... 439/374, 350, 74, 578
See application file for complete search history.

(56) References Cited

U.S. PATENT DOCUMENTS

| | | | | |
|---|---|---|---|---|
| 4,883,435 | A * | 11/1989 | Seidler | 439/876 |
| 6,296,530 | B1 * | 10/2001 | Yoneda et al. | 439/701 |
| 6,781,499 | B2 * | 8/2004 | Steiner | 336/192 |
| 7,456,717 | B2 * | 11/2008 | Grueso et al. | 336/192 |
| 7,762,846 | B1 * | 7/2010 | Whiteman et al. | 439/607.23 |
| 7,909,668 | B2 * | 3/2011 | McAlonis et al. | 439/891 |
| 8,157,595 | B2 * | 4/2012 | Saraswat et al. | 439/620.09 |
| 8,747,168 | B2 * | 6/2014 | Kida | 439/701 |
| 8,920,186 | B2 * | 12/2014 | Shishikura | 439/352 |
| 2004/0018777 | A1 * | 1/2004 | Vanden Wymelenberg et al. | 439/701 |

FOREIGN PATENT DOCUMENTS

| | | |
|---|---|---|
| CN | 102867625 A | 1/2013 |
| TW | 433657 | 5/2001 |
| TW | 200910701 | 3/2009 |

OTHER PUBLICATIONS

Office Action from corresponding Taiwanese application issued Dec. 17, 2014. 3 pages.
Office action dated Aug. 6, 2015 issued in corresponding CN patent application No. 2013100197063.8, 4 pages.

* cited by examiner

*Primary Examiner* — Alexander Gilman
(74) *Attorney, Agent, or Firm* — Muncy, Geissler, Olds & Lowe, P.C.

(57) ABSTRACT

A fly line connector is disclosed. A pin is connected to a main body. A fly line is wrapped around the pin. A first engaging portion is formed on the main body. A first engaging hole is formed in the main body and is opposite to the first engaging portion. When a number of the fly line connectors are combined together, the first engaging portion of one of the fly line connectors is engaged with the first engaging hole of the other one of the fly line connectors.

17 Claims, 13 Drawing Sheets

FLY LINE CONNECTOR

CROSS REFERENCE TO RELATED APPLICATIONS

This Application claims priority of Taiwan Patent Application No. 102101904, filed on Jan. 18, 2013, and Taiwan Patent Application No. 102205299 filed on Mar. 22, 2013, the entirety of the above-mentioned patent applications is incorporated by reference herein.

BACKGROUND

1. Technical Field

The present disclosure relates to a component of a magnetic element, and more particularly, to a fly line connector of a magnetic element.

2. Description of the Related Art

A magnetic element such as transformer and a main circuit board are generally disposed in a power supply. To plug a fly line extending from the transformer into the main circuit board, the fly line is pressed and welded to a fly line terminal in advance. The fly line terminal with the fly line is then plugged into the main circuit board.

For example, as shown in FIG. 1, a conventional fly line terminal 1 comprises a fly line supporting portion 10 and two pressing portions 20 connected to the fly line supporting portion 10. After a fly line (not shown) passes through the fly line supporting portion 10 via the pressing portions 20, the pressing portions 20 are pressed downward onto the fly line, fixing the fly line to the fly line supporting portion 10.

Nevertheless, the conventional fly line terminal 1 has the following drawbacks.

The fly line terminal 1 can support only one fly line. Thus, when multiple fly lines of a device or a transformer need to be connected to another device, the same amount of a fly line terminals 1 must be used. Namely, the multiple fly lines cannot be integrated, thereby making the manufacturing process complicated and increasing manufacturing costs.

Moreover, an additional pressing fixture is required for operation of the pressing portions 20. Specifically, different-sized fly line terminals 1 or pressing portions 20 require different pressing fixtures.

Furthermore, the diameter for the fly line for each type of a fly line terminal 1 is different. Thus, when a device or transformer has fly lines with different sizes or diameters, different types of fly line terminals 1 must be used, thereby making inconvenience in the manufacturing process and increasing the manufacturing costs.

Additionally, the structure of the fly line terminal 1 is fragile structure and thus easily breaks.

In addition, the fly line terminal 1 cannot be reused. Namely, when reworking the fly line terminal 1 containing the fly line, the old fly line and fly line terminal 1 must be replaced by new ones, thereby increasing manufacturing costs.

BRIEF SUMMARY

A detailed description is given in the following embodiments with reference to the accompanying drawings.

An exemplary embodiment of the disclosure provides a combined-type fly line connector comprising a main body, at least one pin, at least one first engaging portion, and at least one first engaging hole. The pin is connected to the main body. A fly line is wrapped around the pin. The at least one first engaging portion is formed on the main body. The at least one first engaging hole is formed in the main body and is opposite to the at least one first engaging portion. When at least two of the combined-type fly line connectors are combined together, the at least one first engaging portion of one of the combined-type fly line connectors is engaged with the at least one first engaging hole of the other of the combined-type fly line connectors.

The combined-type fly line connector further comprises at least one second engaging portion and at least one second engaging hole respectively formed on and in the main body and opposite to each other. An axis line between the at least one second engaging portion and the at least one second engaging hole is perpendicular to an axis line between the at least one first engaging portion and the at least one first engaging hole. When at least two of the combined-type fly line connectors are combined together, the at least one second engaging portion of one of the combined-type fly line connectors is engaged with the at least one second engaging hole of the other of the combined-type fly line connectors.

In the above-mentioned embodiment, the at least one first engaging portion includes a latch or a hook, and the at least one second engaging portion includes a latch or a hook.

In the above-mentioned embodiment, the main body comprises a hollow portion corresponding to the pin. The fly line is wrapped around the pin through the hollow portion.

In the above-mentioned embodiment, the plurality of first engaging portion comprises a latch or a hook.

In the above-mentioned embodiment, the plurality of second engaging portion comprises a latch or a hook.

In the above-mentioned embodiment, the pin comprises conductive material.

In the above-mentioned embodiment, the combined-type fly line connector further includes at least one opening, at least one passage and at least two grooves. The main body includes an upper surface and a lower surface opposite to the upper surface, and the fly line connector includes at least two pins, the at least one opening is disposed on the upper surface of the main body, the at least one passage is located in the main body and connected to the at least one opening, the at least two grooves are disposed between the at least one passage and the lower surface of the main body to connect the at least one passage to the lower surface of the main body, the at least two pins are disposed on the lower surface of the main body and respectively corresponding to one of the at least two grooves.

In the above-mentioned embodiment, the combined-type fly line connector further includes a supporting member, wherein the main body has a front surface and a rear surface opposite to the front surface, and the supporting member is disposed on the rear surface of the main body and extends along a direction substantially parallel to the length direction of the pin.

Another exemplary embodiment of the disclosure provides a fly line connector comprising a main body and at least two pins. The main body has an upper surface, a lower surface opposite to the upper surface, and a front surface connected between the upper and the lower surfaces. The main body comprises at least one opening, at least one passage, and at least two grooves. The opening is disposed on the upper surface of the main body. The passage is located in the main body and connected to the opening. The two grooves are disposed between the lower surface of the main body and the passage to connect the passage to the lower surface of the main body. The two pins are disposed on the lower surface of the main body and respectively corresponding to the two grooves.

In the above-mentioned embodiment, a first region and a second region are defined at the lower surface of the main body, and a distance between the first region and the upper surface is larger than a distance between the second region and the upper surface, wherein the two grooves comprise a first groove and a second groove, the first groove is disposed between the first region and the passage to connect the first region to the passage, and the second groove is disposed between the second region and the passage to connect the second region to the passage.

In the above-mentioned embodiment, a hollow structure communicating with the passage and the two grooves is disposed on the front surface of the main body. A depth of an inner surface of the passage relative to the front surface of the main body is larger than or equal to a depth of the an inner surface of one of the two grooves relative to the front surface of the main body.

In the above-mentioned embodiment, the passage comprises a first inner surface perpendicular to the upper surface of the main body, and a second inner surface connected to an inner surface of one of the two grooves, wherein an included angle is formed between the first inner surface and the second inner surface of the passage, and a depth of the first inner surface of the passage relative to the front surface of the main body is larger than a depth of the second inner surface of the passage relative to the front surface of the main body.

In the above-mentioned embodiment, each of the two grooves comprises a first inner surface connected to an inner surface of the passage, and a second inner surface connected to the lower surface of the main body, wherein an included angle is formed between the first inner surface and the second inner surface of each of the two grooves, and a depth of the first inner surface of one of the two grooves relative to the front surface of the main body is larger than a depth of the second inner surface of one of the corresponding groove relative to the front surface of the main body.

In the above-mentioned embodiment, the fly line connector further comprises a supporting member, wherein the main body has a rear surface opposite to the front surface, and the supporting member is disposed on the rear surface of the main body and extends along a direction substantially parallel to the length direction of the plurality of pins.

In the above-mentioned embodiment, the fly line connector is adapted to be joined by at least two fly lines of a magnetic element, wherein the at least two fly lines are inserted into the fly line connector via the opening and sequentially pass through the passage, and the two grooves to electrically connect to the two pins. The magnetic element may be a transformer, an inductor, or a filter.

In the above-mentioned embodiment, the fly line connector further includes at least one first engaging portion and at least one first engaging hole, the at least one first engaging portion is formed on a side surface of the main body, the at least one first engaging hole is formed in the main body and opposite to the at least one first engaging portion, wherein, when at least two of the fly line connectors are combined together, the at least one first engaging portion of one of the fly line connectors is engaged with the at least one first engaging hole of the other of the fly line connectors.

In the above-mentioned embodiment, the fly line connector further includes at least one second engaging portion and at least one second engaging hole, the at least one second engaging portion is formed on a front surface of the main body, the at least one second engaging hole is formed in the main body and opposite to the at least one second engaging portion, wherein an axis line between the at least one second engaging portion and the at least one second engaging hole is perpendicular to an axis line between the at least one first engaging portion and the at least one first engaging hole, and when at least two of the fly line connectors are combined together, the at least one second engaging portion of one of the fly line connectors is engaged with the at least one second engaging hole of the other of the fly line connectors.

Yet another exemplary embodiment of the disclosure provides a fly line connector comprising a main body and a plurality of pins. The main body has an upper surface, a lower surface opposite to the upper surface, and a front surface connected between the upper and the lower surfaces, wherein two first regions and two second regions are defined at the lower surface of the main body in an alternating manner. The main body comprises two openings, two passages, and a plurality of grooves. The two openings are respectively disposed on the upper surface of the main body. The two passages are respectively located in the main body and connected to the two openings. The plurality of grooves is disposed between the lower surface of the main body and the two passages to connect the two passages to the lower surface of the main body. The plurality of pins is disposed on the lower surface of the main body and respectively corresponding to one of the plurality of grooves.

In the above-mentioned embodiment, a distance between one of the two first regions and the upper surface is larger than a distance between one of the two second regions and the upper surface, and the plurality of grooves comprise two first grooves and two second grooves, wherein the two first grooves are respectively disposed between one of the two first regions and one of the corresponding passages to connect the two first regions to the two passages, and the two second grooves are respectively disposed between one of the two second regions and one of the corresponding passages to connect the two second regions to the two passages.

In the above-mentioned embodiment, a hollow structure communicating with two passages and the plurality of grooves is disposed on the front surface of the main body.

In the above-mentioned embodiment, each of the two passages has an inner surface, and each of the plurality of grooves has an inner surface, wherein a depth of the inner surface of one of the two passages relative to the front surface of the main body is larger than or equal to a depth of the inner surface of one of the corresponding grooves relative to the front surface of the main body.

In the above-mentioned embodiment, each of the two passages comprises a first inner surface perpendicular to the upper surface of the main body, and a second inner surface connected to inner surfaces of the plurality of grooves, wherein an included angle is formed between the first inner surface and the second inner surface of each of the two passages, and a depth of the first inner surface of one of the two passages relative to the front surface of the main body is larger than a depth of the second inner surface of the corresponding passage relative to the front surface of the main body.

In the above-mentioned embodiment, each of the plurality of grooves comprises a first inner surface connected to one of the two passages, and a second inner surface connected to the lower surface of the main body, wherein an included angle is formed between the first inner surface and the second inner surface of each of the plurality of grooves, and a depth of the first inner surface of one of the plurality of grooves relative to the front surface of the main body is larger than a depth of the second inner surface of the corresponding groove relative to the front surface of the main body.

In the above-mentioned embodiment, the fly line connector further comprises a supporting member, wherein the main body has a rear surface opposite to the front surface, and the supporting member is disposed on the rear surface of the main body and extends along a direction substantially parallel to the length direction of the plurality of pins.

In the above-mentioned embodiment, the fly line connector is adapted to be joined by a plurality of fly lines of a magnetic element, wherein the plurality of fly lines are respectively inserted into the fly line connector via one of the two openings, and sequentially pass through the corresponding passage and the corresponding grooves to electrically connect to the plurality of pins. The magnetic element may be a transformer, an inductor, or a filter.

BRIEF DESCRIPTION OF THE DRAWINGS

The present disclosure can be more fully understood by reading the subsequent detailed description and examples with references made to the accompanying drawings, wherein.

DETAILED DESCRIPTION

The following description is of the best-contemplated mode of carrying out the disclosure. This description is made for the purpose of illustrating the general principles of the disclosure and should not be taken in a limiting sense. The scope of the disclosure is best determined by reference to the appended claims.

Figure 1:
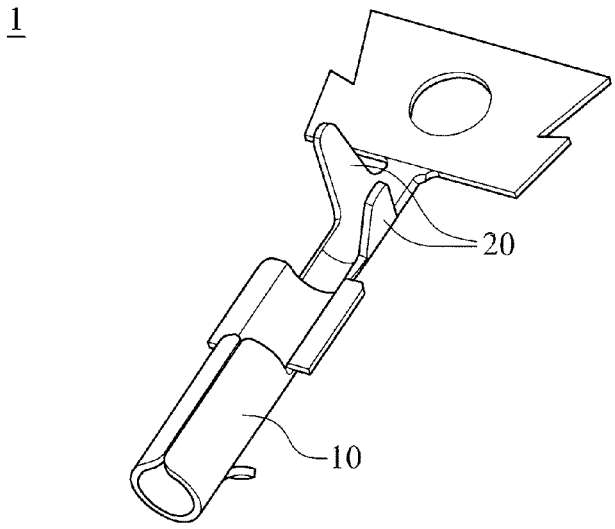
FIG. 1 ( PRIOR ART )
FIG. 1 is a schematic perspective view of a conventional fly line terminal.
Figure 2:
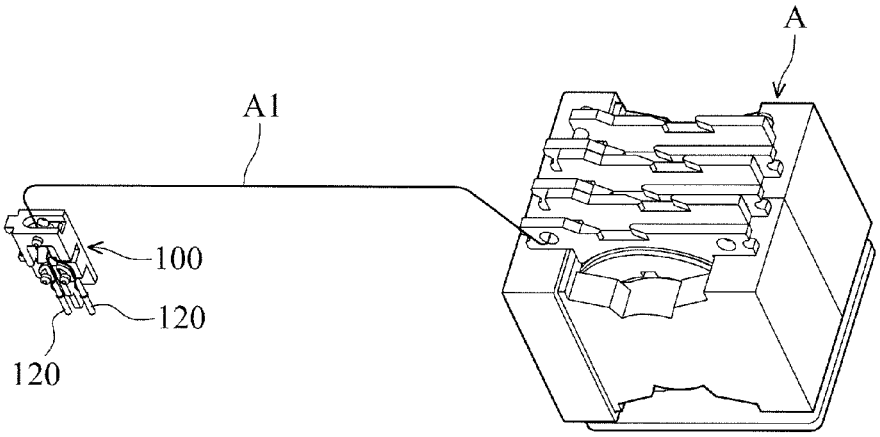
FIG. 2 shows an application of a fly line connector according to a first embodiment of the disclosure.

Referring to FIG. 2, a fly line connector 100 can be joined to a fly line A1 extending from a transformer A. The fly line connector 100 containing the fly line A1 can be then plugged into a main circuit (not shown).

Figure 3:
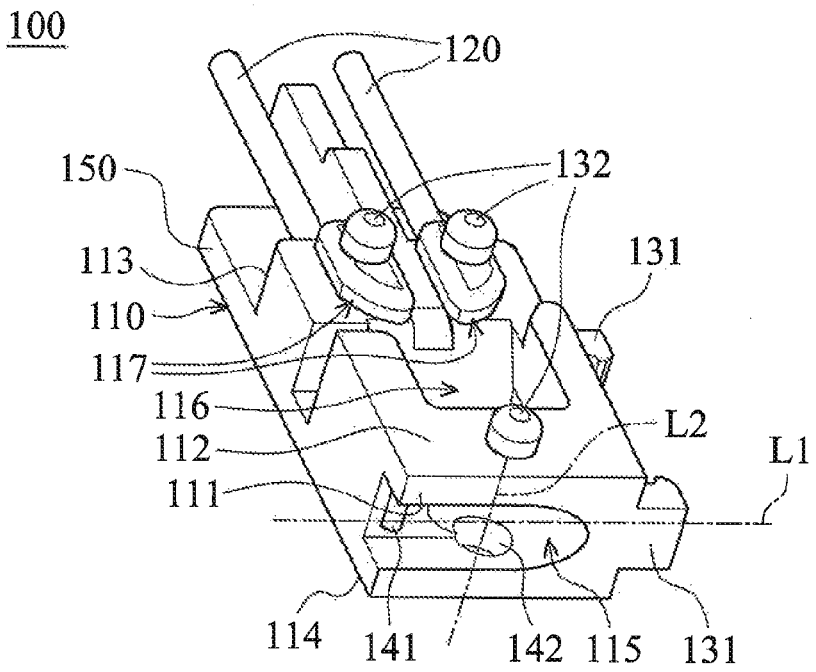
FIG. 3 is a schematic perspective view of the fly line connector according to the first embodiment of the disclosure.
Figure 4:
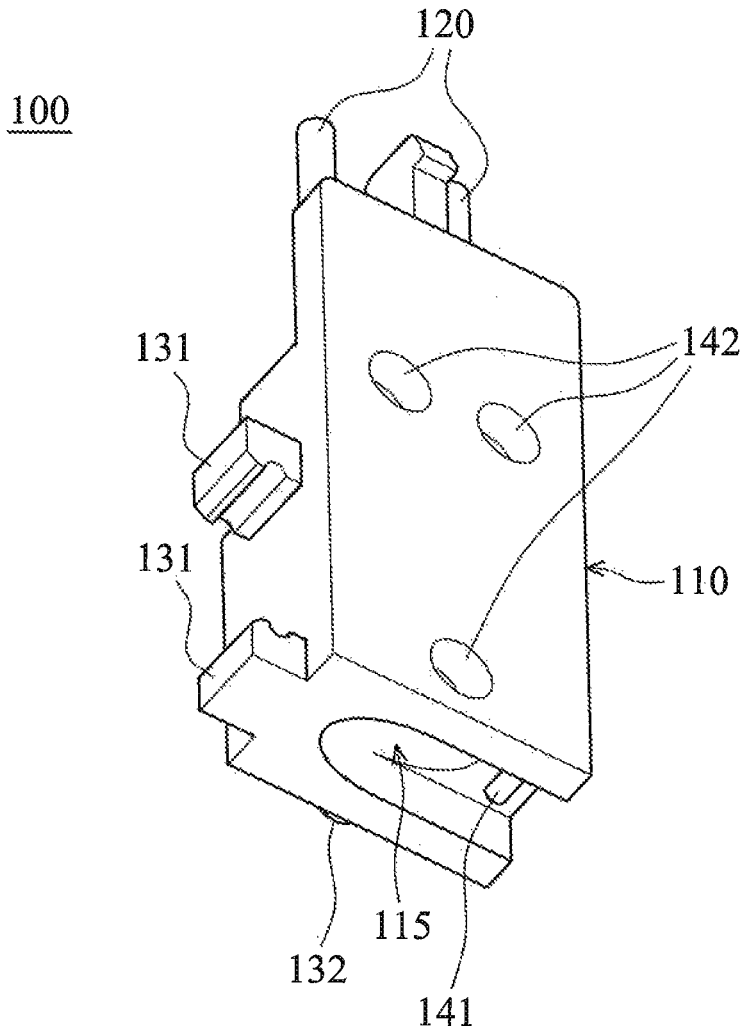
FIG. 4 is another schematic perspective view of the fly line connector according to the first embodiment of the disclosure.

Referring to FIGS. 3-4, the fly line connector 100 comprises a main body 110, a plurality of pins 120, a plurality of first engaging portions 131, a plurality of first engaging holes 141, a plurality of second engaging portions 132, a plurality of second engaging holes 142.

The main body 110 has an upper surface 111, a lower surface 113 opposite to the upper surface 111, a front surface 112 connected between the upper surface 111 and the lower surfaces 113, and a rear surface 114 opposite to the front surface 112. The main body 110 includes an opening 115, a passage 116 and two grooves 117.

The opening 115 is disposed on the upper surface 111 of the main body 110, The passage 116 is located in the main body 110 and connected to the opening 115, the two grooves 117 are disposed between the passage 116 and the lower surface 113 of the main body 110 to connect the passage 116 to the lower surface 113 of the main body 110.

The two pins 120 are disposed on the lower surface 113 of the main body 110 and respectively corresponding to one of the two grooves 117. Here, the plurality of pins 120 may be composed of conductive material.

The plurality of first engaging portions 131 are formed on one side of the main body 110. Here, the plurality of first engaging portions 131 may be latches or hooks and are not limited thereto.

The plurality of first engaging holes 141 are formed in the main body 110 and are respectively opposite to the plurality of first engaging portions 131.

The plurality of second engaging portions 132 are formed on the other side of the main body 110. Similarly, the plurality of second engaging portions 132 may be latches or hooks and are not limited thereto.

Figure 6:
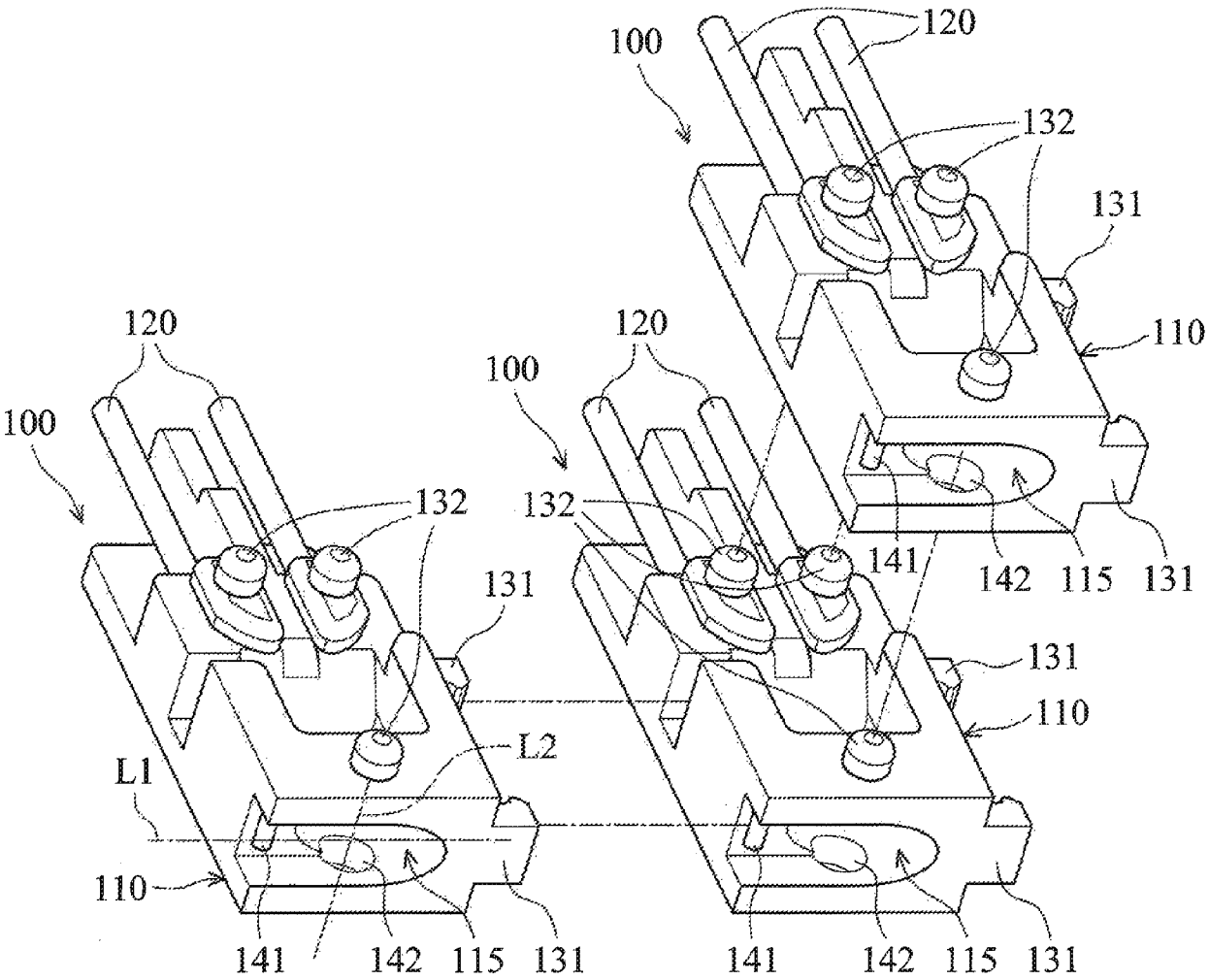
FIG. 6 is an exploded perspective view of FIG. 5.

The plurality of second engaging holes 142 are formed in the main body 110 and are respectively opposite to the plurality of second engaging portions 132. In this embodiment, an axis line L2 between each second engaging portion 132 and each corresponding second engaging hole 142 is perpendicular to an axis line L1 between each first engaging portion 131 and each corresponding first engaging hole 141, as shown in FIG. 3 and FIG. 6. Namely, the side, of the main body 110, on which the plurality of first engaging portions 131 are formed is perpendicular to the side, of the main body 110, on which the plurality of second engaging portions 132 are formed.

Accordingly, when the fly line connector 100 is joined to the fly line A1 shown by FIG. 2, the fly line A1 is wrapped around the pin 120 through the opening 115 of the main body 110.

Figure 5:
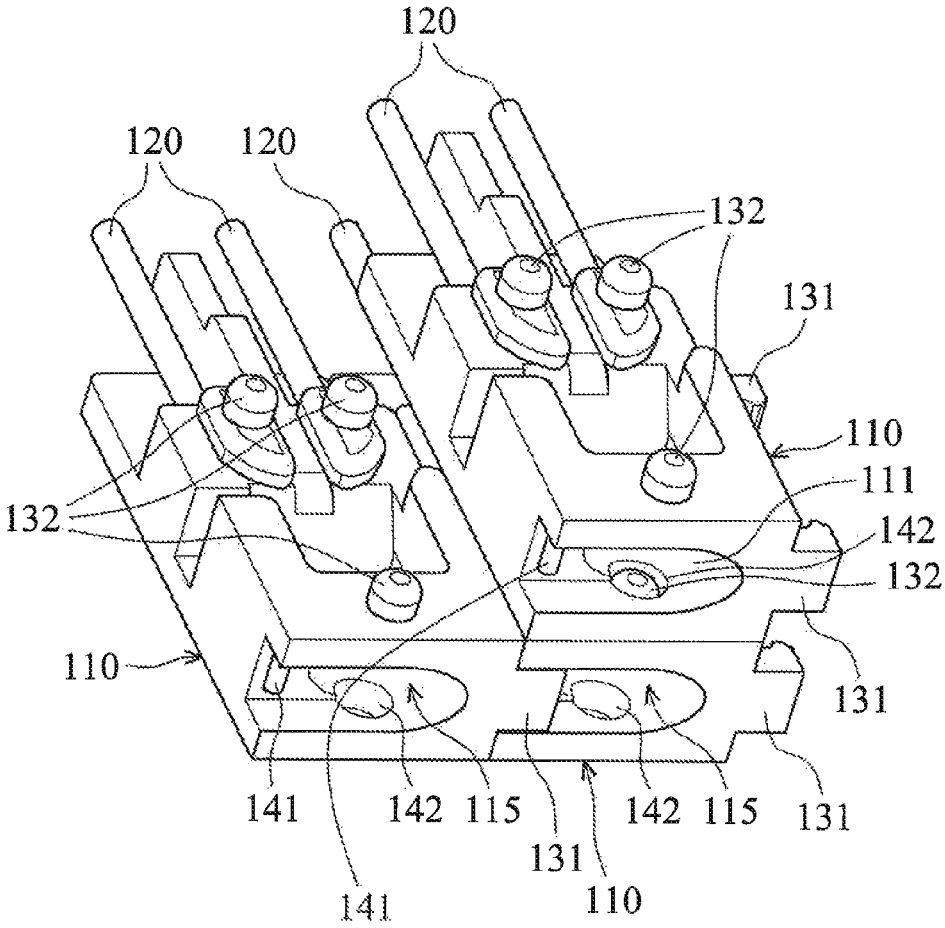
FIG. 5 is a schematic perspective view showing multiple fly line connectors, according to the first embodiment of the disclosure, being combined together.
Figure 7:
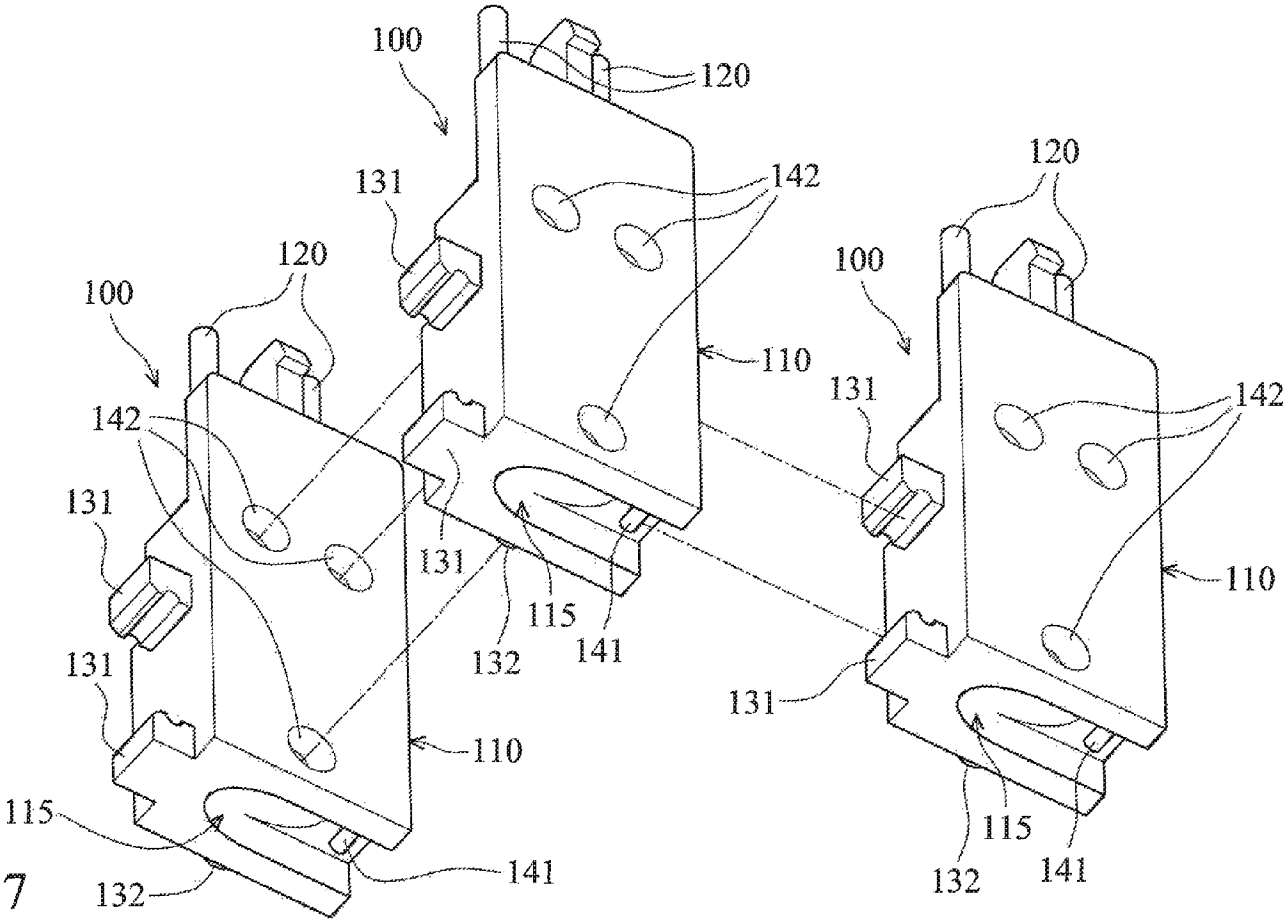
FIG. 7 is another exploded perspective view of FIG. 5.

Moreover, as shown in FIGS. 5, 6, and 7, when multiple fly line connectors 100 are combined together, the plurality of first engaging portions 131 of one of the fly line connectors 100 are engaged with the plurality of first engaging holes 141 of the other of the fly line connectors 100, and/or the plurality of second engaging portions 132 of one of the fly line connectors 100 are engaged with the plurality of second engaging holes 142 of the other of the fly line connectors 100. Accordingly, by arrangement of the plurality of first engaging portions 131, the plurality of first engaging holes 141, the plurality of second engaging portions 132, and the plurality of second engaging holes 142, multiple fly line connectors 100 can be combined together along two directions, thereby benefiting arrangement of the plurality of fly lines or fly line connectors 100 on the main circuit board. It is noted that an unlimited number of a fly line connectors 100 can be combined together to formed a combined-type fly line connector, facilitating arrangement of the plurality of fly lines or fly line connectors 100 on the main circuit board.

Figure 8:
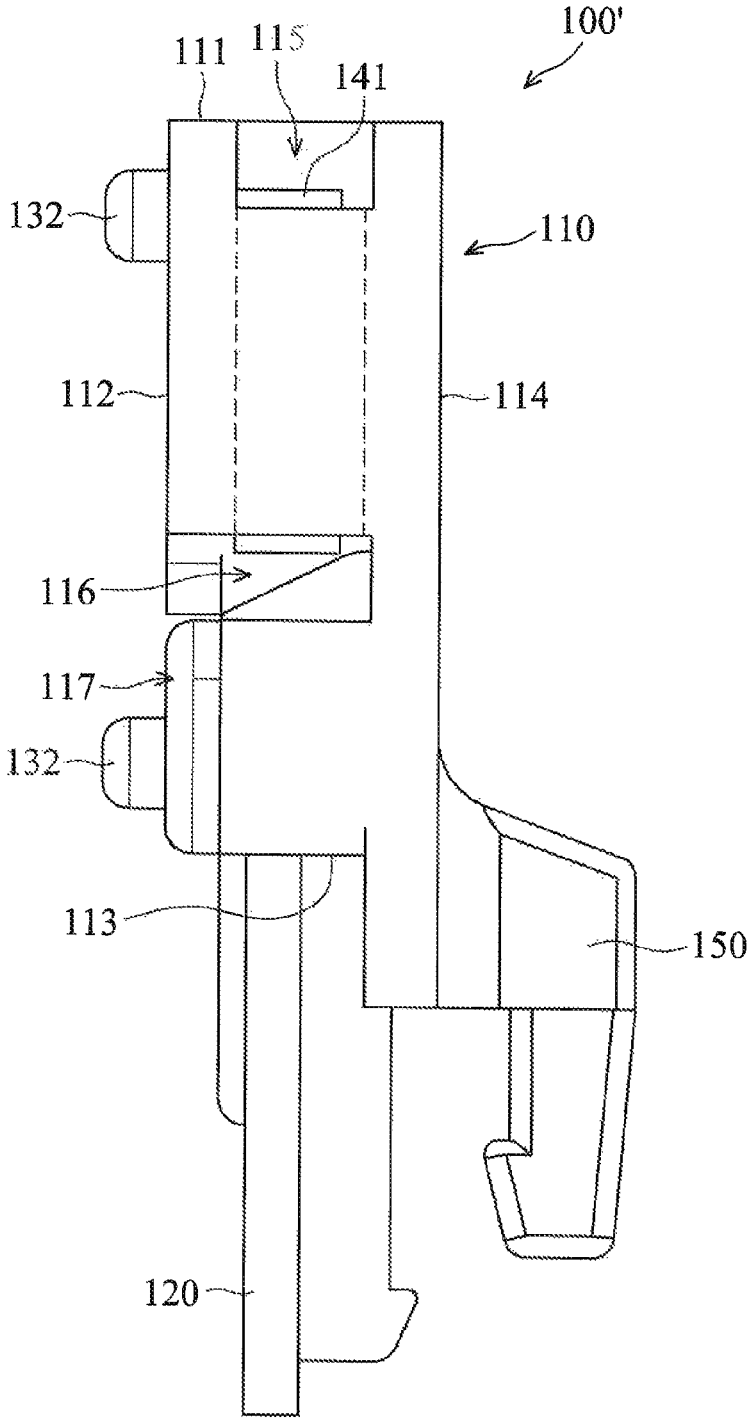
FIG. 8 is a schematic perspective view of the fly line connector according to a second embodiment of the disclosure.

Referring to FIG. 8, a fly line connector 100' according to a second embodiment of the disclosure is provided. Difference between the fly line connector 100' and the fly line connector 100 includes that, the fly line connector 100' further includes a supporting member 150. The supporting member 150 is disposed on the rear surface 114 of the main body 110 and extends along a direction substantially parallel to the length direction of the two pins 120. When the fly line connector 100' is disposed on a circuit board (not shown), the supporting member 150 is abutted against the circuit board so as to enhance stability of the fly line connector 100'.

Figure 9:
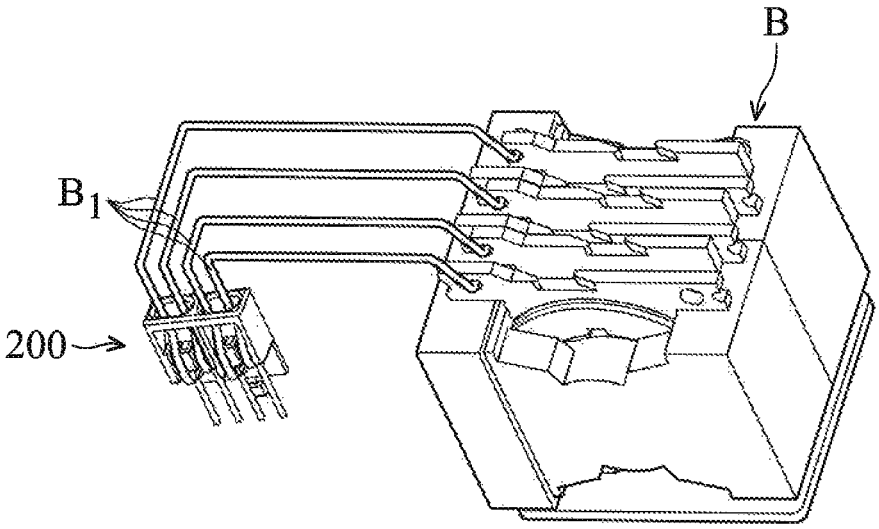
FIG. 9 shows an application of a fly line connector according to a third embodiment of the disclosure.

Referring to FIG. 9, a fly line connector 200 of another embodiment can be joined to a plurality of fly lines B1 extending from a transformer B. The fly line connector 200 containing the plurality of fly lines B1 can be then plugged into a main circuit (not shown).

Figure 10:
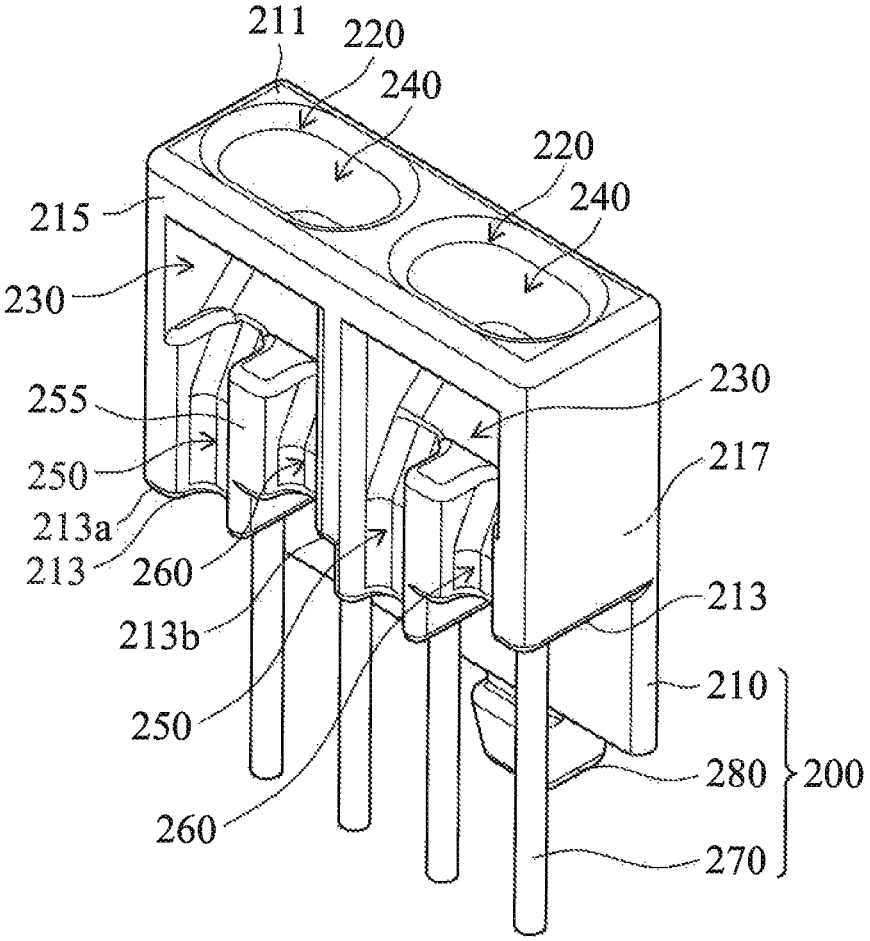
FIG. 10 is a schematic perspective view of the fly line connector according to the third embodiment of the disclosure.

Referring to FIGS. 9 and 10, the plurality of fly lines B1 are inserted into the fly line connector 200 via two openings 220 and sequentially pass through the passages 240 and two grooves 250, 260 to electrically connect to two pins 270.

The structural feature of the fly line connector 200 is described in detail hereinafter. The fly line connector 200 includes a main body 210, four pins 270 and a supporting member 280. The main body 210 has an upper surface 211, a lower surface 213 opposite to the upper surface 211, a front surface 215 connected between the upper surface 211 and the lower surfaces 213, and a rear surface 217 opposite to the front surface 215. The main body 210 includes two openings 220, two hollow structures 230, two passages 240 and two pairs of grooves 250 and 260.

As shown in FIG. 10, two openings 220 are adjacent to each other and disposed on the upper surface 211 of the main body 210, and the two hollow structures 230 are adjacent to each other and disposed on the front surface 215 of the main body 210. The two passages 240 are located in the main body 210 and respectively connected to the two openings 220. The two pairs of grooves 250 and 260 are respectively connected between one of the two passages 240 and the lower surface 213 of the main body 210. The two hollow structures 230 are connected to the two passages 240 and the two pairs of the grooves 250 and 260. Namely, the two passages 240 and the two pairs of the grooves 250 and 260 are exposed to the outside surroundings via the two hollow structures 230 on the front surface 215 of the main body 210.

Figure 11:
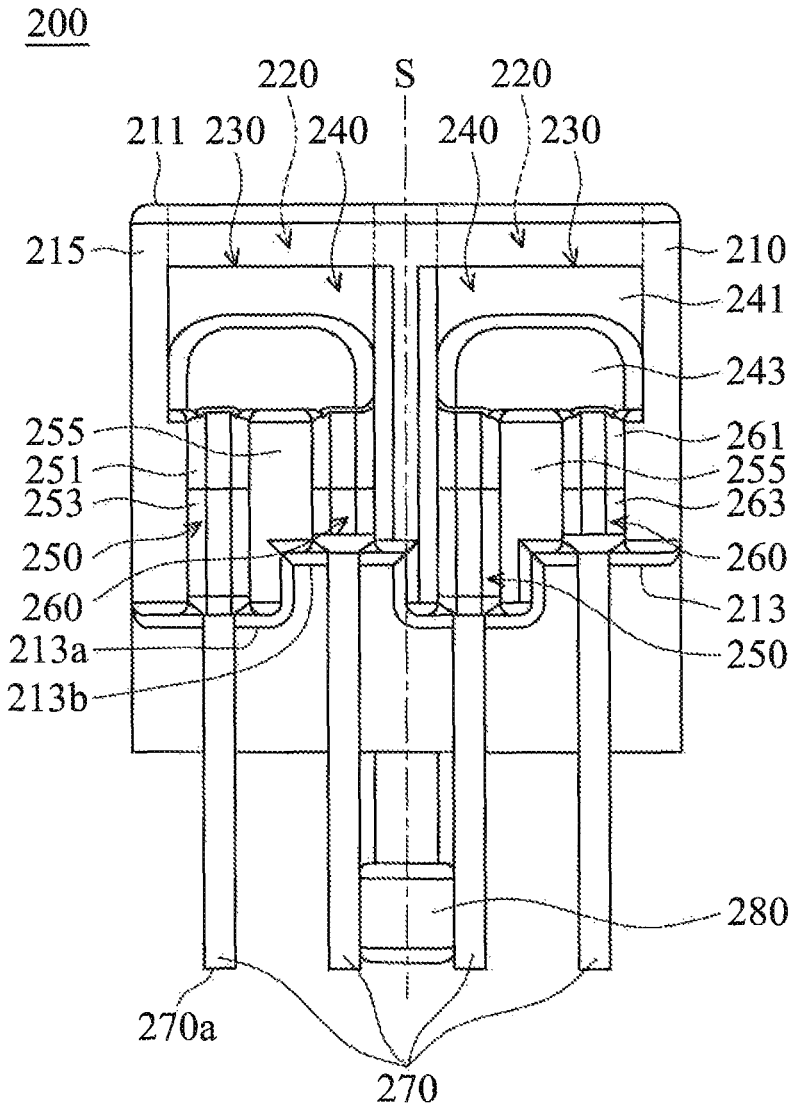
FIG. 11 is a front view of the fly line connector according to the third embodiment of the disclosure.

As shown in FIG. 11, the two openings 220, the two hollow structures 230, the two passages 240 and the two pairs of grooves 250 and 260 arranged at two opposite sides of the central line S have substantially the same structural features. Thus, only the structural features that refer to the opening 220, the hollow structure 230, the passage 240 and the pair of grooves 250 and 260 arranged on the same side of the central line S will be illustrated in the following description for brevity of the specification.

In the embodiment, the passage 240 includes a first inner surface 241 and a second inner surface 243, and the two grooves 250 and 260 respectively include first inner surfaces 251 and 261 and second inner surfaces 253 and 263. The first inner surface 241 of the passage 240 is perpendicular to the upper surface 211 of the main body 210, and the second inner surface 243 of the passage 240 is connected to the first inner surfaces 251 and 261 of the two grooves 250 and 260. An included angle is formed between the first inner surface 241 and the second inner surfaces 243 of the passage 240, so that a depth of the first inner surface 241 of the passage 240 relative to the front surface 215 of the main body 210 is larger than a depth of the second inner surface 243 of the passage 240 relative to the front surface 215 of the main body 210.

On the other hand, the first inner surface 251 of the groove 250 is connected to the second inner surface 243 of the passage 240, and the second inner surface 253 is connected between a first region 213*a* of the lower surface 213 of the main body 210 and the first inner surface 251 of the groove 250. An included angle is formed between the first inner surface 251 and the second inner surfaces 253 of the grooves 250, so that a depth of the first inner surface 251 of the groove 250 relative to the front surface 215 of the main body 210 is larger than a depth of the second inner surface 253 of the groove 250 relative to the front surface 215 of the main body 210.

Similarly, the first inner surface 261 of the groove 260 is connected to the second inner surface 243 of the passage 240, and the second inner surface 263 is connected between a second region 213*b* of the lower surface 213 of the main body 210 and the first inner surface 261 of the groove 260. An included angle is formed between the first inner surface 261 and the second inner surface 263 of the grooves 260, so that a depth of the first inner surface 261 of the groove 260 relative to the front surface 215 of the main body 210 is larger than a depth of the second inner surface 263 of the groove 260 relative to the front surface 215 of the main body 210.

Generally, as shown in FIG. 11, since a distance between the first region 213*a* of the lower surface 213 and the upper surface 211 is larger than a distance between the second region 213*b* of the lower surface 213 and the upper surface 211, a length of the groove 250 is larger than a length of the groove 260. Additionally, a protrusion 255 is disposed between the groove 250 and the groove 260, so that the groove 250 and the groove 260 are not connected to each other. Moreover, a depth of the inner surfaces 241 and 243 of the passage 240 relative to the front surface 215 of the main body 210 is larger than or equal to a depth of the inner surfaces 251, 253, 261 and 263 of the two grooves 250 and 260 relative to the front surface 215 of the main body 210 to facilitate the insertion of the fly line (not shown in FIG. 11).

Figure 12:
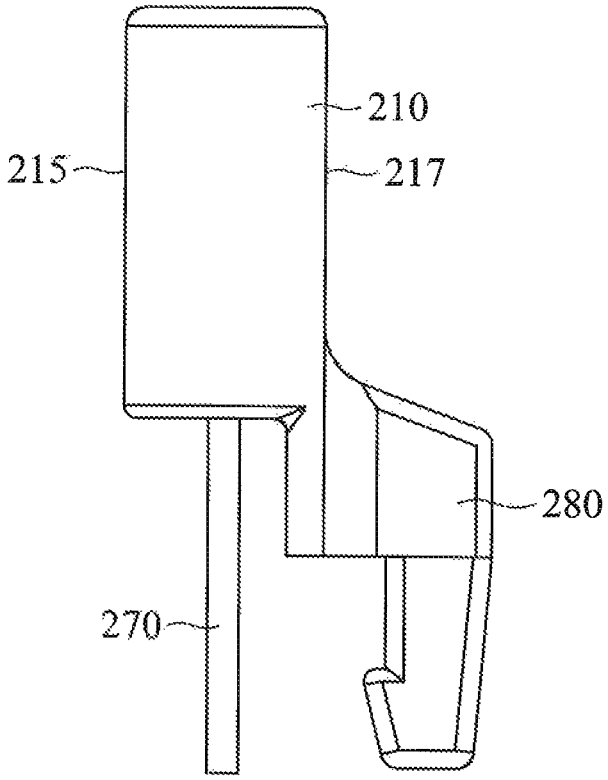
FIG. 12 is side view of the fly line connector according to the third embodiment of the disclosure.

Four pins 240 are respectively disposed on the two first regions 213*a* and two second regions 213*b* of the lower surface 213 of the main body 210 and respectively correspond to one of the grooves 250 and 260. As shown in FIG. 12, the supporting member 280 is disposed on the rear surface 217 of the main body 210 and extends along a direction substantially parallel to the length direction of the plurality of pins 240. To enhance stability of the fly line connector 200, the supporting member 280 is abutted against the circuit board (not shown in FIG. 12) when the fly line connector 200 is disposed on the circuit board.

It is appreciated that while the two openings 220, the two hollow structures 230, the two passages 240 and the two pairs of grooves 250 and 260 arranged at two opposite sides of the central line S have substantially the same structural features, it should not be limited thereto. The arrangement at the two opposite sides of the central line S may be the same or different, and the numbers of the opening 220, the hollow structure 230, the passage 240 and the pair of grooves 250 and 260 can be increased or decreased as required.

Figure 13:
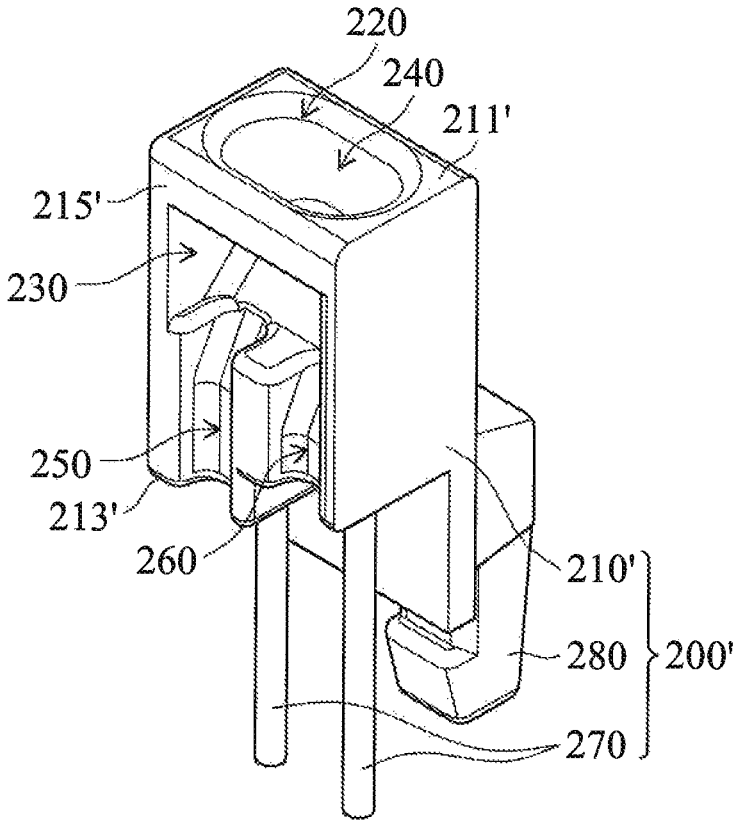
FIG. 13 is a schematic perspective view of the fly line connector according to a fourth embodiment of the disclosure.

For example, referring to FIG. 13, which shows another embodiment of a fly line connector 200', since elements similar with that of the fly line connector 200 shown in FIG. 11 are provided with the same reference numbers, thus, the features thereof are not reiterated in the interest of brevity. Compared with the fly line connector 200, the fly line connector 200' has less available fly lines (not shown in FIG. 13) joined thereto. The fly line connector 200' includes an opening 220, a hollow structure 230, a passage 240 and a pair of grooves 250 and 260. The opening 220 is disposed on an upper surface 211' of the main body 210'. The hollow structure 230 is disposed on a front surface 215' of the main body 210. The passage 240 is located in the main body 210' and connected with the opening 220. The pair of grooves 250 and 260 is disposed between the passage 240 and a lower surface 213' of the main body 210' to connect the passage 240 to the lower surface 213' of the main body 210'. The two pins 270 are disposed on the lower surface 213' of the main body 210' and respectively correspond to one of the grooves 250, 260.

Figure 14:
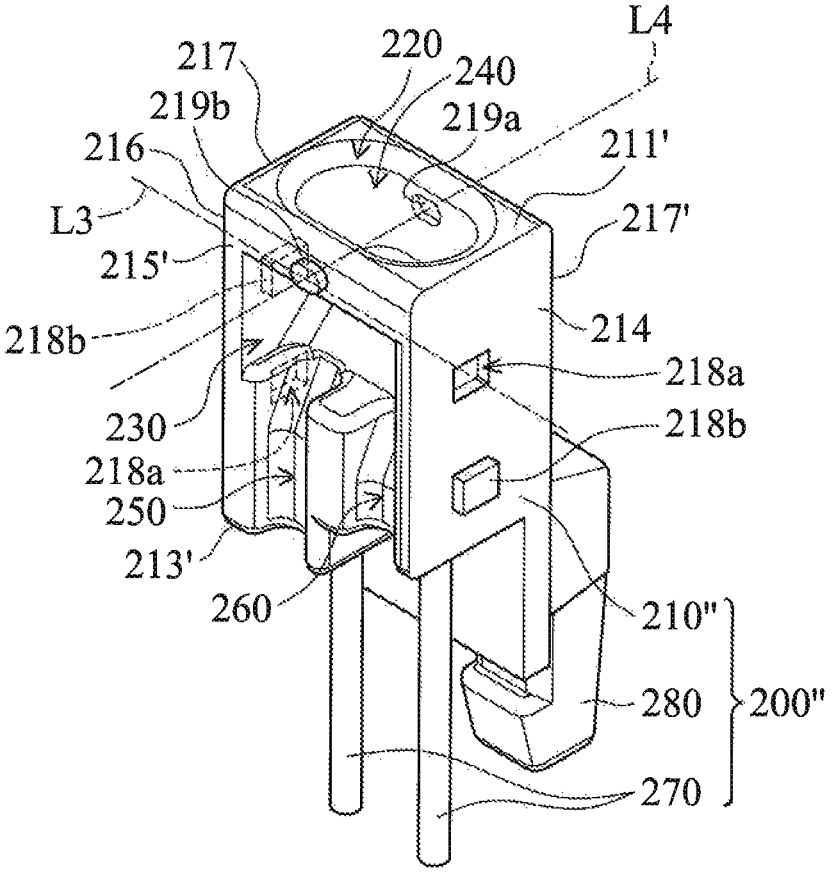
FIG. 14 is a schematic perspective view of the fly line connector according to the fifth embodiment of the disclosure.

Referring to FIG. 14, which shows a fly line connector 200" in accordance with another embodiment of the disclosure. In FIG. 14, components identical to those in FIG. 13 will be represented by similar reference numbers, and the features thereof will not be further described in the interest of brevity. The fly line connector 200" differs from the fly line connector 200' in that the fly line connector 200" further includes two first engaging holes 218*a*, two first engaging portions 218*b*, a second engaging hole 219*a*, and a second engaging portion 219*b*.

The two first engaging portions 218*b* are respectively formed on a first side 214 of the main body 210" and a second side 216 of the main body 210". The two first engaging holes 218*a* are respectively formed on the first side 214 of the main body 210" and the second side 216 of the main body 210". One of the two first engaging portions 218*b* is opposite to one of the two first engaging holes 218*a*.

The second engaging hole 219*a* is formed on the rear side 217' of the main body 210". The second engaging portion 219*b* is formed on the front side 215' of the main body 210". The second engaging portion 219*b* is opposite to the second engaging hole 219*a*.

When at least two of the fly line connectors 200" are combined together, the two first engaging portions 218*b* of one of the fly line connectors 200" are engaged with the two first engaging holes 218*a* of the other of the fly line connectors 200". Moreover, when at least two of the fly line connectors 200" are combined together, the second engaging portion 219*b* of one of the fly line connectors 200" is engaged with the second engaging hole 219*a* of the other of the fly line connectors. An axis LA line defined by the second engaging portion 219*b* and the second engaging hole 219*a* is perpendicular to an axis L3 line defined by the first engaging portion 218*b* and the first engaging hole 218*a*.

In conclusion, the disclosed fly line connector has many advantages as follows.

As a single fly line connector can simultaneously hold a plurality of fly lines (i.e. a plurality of fly lines can be integrated in a single fly line connector), the number of the used fly line connectors can be reduced, thereby reducing manufacturing costs.

Moreover, no additional pressing fixture is required when the plurality of fly lines are joined to the fly line connector.

Furthermore, the fly line connector can hold fly lines with different sizes or diameters Additionally, the fly line connector is provided with an enhanced structural strength and is not easily damaged.

In addition, the fly line connector can be reused. Namely, when reworking of the fly line connector containing the plurality of fly lines is needed, the old fly lines can be removed from the plurality of pins and new fly lines can be then wrapped around the plurality of pins.

Additionally, as the distance between the plurality of pins of the fly line connector is fixed, plugging the fly line connector into the main circuit board is easy and convenient.

While the disclosure has been described by way of example and in terms of preferred embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fly line connector, comprising:

a main body, having an upper surface, a lower surface opposite to the upper surface, and a front surface connected between the upper surface and the lower surface, wherein the main body comprises:

at least one opening, disposed on the upper surface of the main body;

at least one passage, located in the main body and connected to the at least one opening; and at least two grooves, disposed between the at least one passage and the lower surface of the main body to connect the at least one passage to the lower surface of the main body; and at least two pins, disposed on the lower surface of the main body and respectively corresponding to one of the at least two grooves, wherein the fly line connector is adapted to be joined by at least two fly lines of a magnetic element, wherein the at least two fly lines are inserted into the fly line connector via the at least one opening, and sequentially pass through the at least one passage and the at least two grooves to electrically connect to the at least two pins.

2. The fly line connector as claimed in claim 1, wherein a first region and a second region are defined at the lower surface of the main body, and a distance between the first region and the upper surface is larger than a distance between the second region and the upper surface, wherein the at least two grooves comprise a first groove and a second groove, the first groove is disposed between the at least one passage and the first region and to connect the at least one passage to the first region, and the second groove is disposed between the at least one passage and the second region to connect the at least one passage to the second region.

3. The fly line connector as claimed in claim 1, wherein a hollow structure communicating with the at least one passage and the at least two grooves is disposed on the front surface of the main body.

4. The fly line connector as claimed in claim 3, wherein a depth of an inner surface of the at least one passage relative to the front surface of the main body is larger than or equal to a depth of the an inner surface of one of the at least two grooves relative to the front surface of the main body.

5. The fly line connector as claimed in claim 1, wherein the at least one passage comprises a first inner surface perpendicular to the upper surface of the main body, and a second inner surface connected to inner surfaces of the at least two grooves, wherein an included angle is formed between the first inner surface and the second inner surface of the at least one passage, and a depth of the first inner surface of the at least one passage relative to the front surface of the main body is larger than a depth of the second inner surface of the at least one passage relative to the front surface of the main body.

6. The fly line connector as claimed in claim 1, wherein each of the at least two grooves comprises a first inner surface connected to an inner surface of the at least one passage, and a second inner surface connected to the lower surface of the main body, wherein an included angle is formed between the first inner surface and the second inner surface of each of the at least two grooves, and a depth of the first inner surface of one of the at least two grooves relative to the front surface of the main, body is larger than a depth of the second inner surface of one of the corresponding groove relative to the front surface of the main body.

7. The fly line connector as claimed in claim 1, further comprising a supporting member, wherein the main body has a rear surface opposite to the front surface, and the supporting member is disposed on the rear surface of the main body and extends along a direction substantially parallel to the length direction of the at least two pins.

8. The fly line connector as claimed in claim 1, further comprising at least one first engaging portion and at least one first engaging hole, the at least one first engaging portion is formed on a side surface of the main body, the at least one first engaging hole is formed in the main body and opposite to the at least one first engaging portion, when at least two of the fly line connectors are combined together, the at least one first engaging portion of one of the fly line connectors is engaged with the at least one first engaging hole of the other of the fly line connectors.

9. The fly line connector as claimed in claim 8, further comprising at least one second engaging portion and at least one second engaging hole, wherein the at least one second engaging portion is formed on a front surface of the main body, the at least one second engaging hole is formed in the main body and opposite to the at least one second engaging portion, wherein an axis line between the at least one second engaging portion and the at least one second engaging hole is perpendicular to an axis line between the at least one first engaging portion and the at least one first engaging hole, when at least two of the fly line connectors are combined together, the at least one second engaging portion of one of the fly line connectors is engaged with the at least one second engaging hole of the other of the fly line connectors.

10. A fly line connector, comprising:

a main body, having an upper surface, a lower surface opposite to the upper surface, and a front surface connected between the upper surface and the lower surface, wherein the main body comprises:

two openings, respectively disposed on the upper surface of the main body;

two passages, respectively located in the main body and connected to the two openings; and a plurality of grooves, disposed between the two passages and the lower surface of the main body to connect the two passages to the lower surface of the main body; and a plurality of pins, disposed on the lower surface of the main body and respectively corresponding to one of the plurality of grooves, wherein the fly line connector is adapted to be joined by a plurality of fly lines of a magnetic element, wherein the plurality of fly lines are respectively inserted into the fly line connector via the two openings, and sequentially pass through the corresponding passage and the corresponding grooves to electrically connect to the plurality of pins.

11. The fly line connector as claimed in claim 10, wherein two first regions and two second regions are defined at the lower surface of the main body in an alternating manner, and a distance between one of the two first regions and the upper surface is larger than a distance between one of the two second regions and the upper surface, and the plurality of grooves comprise two first grooves and two second grooves, wherein the two first grooves are respectively disposed between one of the corresponding passages and one of the two first regions to connect the two passages to the two first regions, and the two second grooves are respectively disposed between one of the corresponding passages and one of the two second regions to connect the two passages to the two second regions.

12. The fly line connector as claimed in claim 10, wherein a hollow structure communicating with two passages and the plurality of grooves is disposed on the front surface of the main body.

13. The fly line connector as claimed in claim 10, wherein each of the two passages has an inner surface, and each of the plurality of grooves has an inner surface, wherein a depth of the inner surface of one of the two passages relative to the front surface of the main body is larger than or equal to a depth of the inner surface of one of the corresponding grooves relative to the front surface of the main body.

14. The fly line connector as claimed in claim 10, wherein each of the two passages comprises a first inner surface perpendicular to the upper surface of the main body, and a second inner surface connected to inner surfaces of the plurality of grooves, wherein an included angle is formed between the first inner surface and the second inner surface of each of the two passages, and a depth of the first inner surface of one of the two passages relative to the front surface of the main body is larger than a depth of the second inner surface of the corresponding passage relative to the front surface of the main body.

15. The fly line connector as claimed in claim 10, wherein each of the plurality of grooves comprises a first inner surface connected to one of the two passages, and a second inner surface connected to the lower surface of the main body, wherein an included angle is formed between the first inner surface and the second inner surface of each of the plurality of grooves, and a depth of the first inner surface of one of the plurality of grooves relative to the front surface of the main body is larger than a depth of the second inner surface of the corresponding groove relative to the front surface of the main body.

16. The fly line connector as claimed in claim 10, further comprising a supporting member, wherein the main body has a rear surface opposite to the front surface, and the supporting member is disposed on the rear surface of the main body and extends along a direction substantially parallel to the length direction of the plurality of pins.

17. A fly line connector, comprising:

a main body;

at least one pin connected to the main body, wherein a fly line is wrapped around the pin;

at least one first engaging portion formed on the main body; and at least one first engaging hole formed in the main body and opposite to the at least one first engaging portion, when at least two of the fly line connectors are combined together, the at least one first engaging portion of one of the fly line connectors is engaged with the at least one first engaging hole of the other of the fly line connectors, wherein the fly line connector is adapted to be joined by at least two fly lines of a magnetic element, wherein the at least two fly lines are inserted into the fly line connector via the at least one opening, and sequentially pass through the at least one passage and the at least two grooves to electrically connect to the at least two pins.

* * * * *